United States Patent [19]

Gutierrez

[11] 4,063,616

[45] Dec. 20, 1977

[54] SAFETY LADDER WITH CASTER ASSEMBLY MOVEABLE POSITIVELY TO A RETRACTED POSITION

[76] Inventor: Ernest F. Gutierrez, P.O. Box 84, Bristol, Ill. 60512

[21] Appl. No.: 702,885

[22] Filed: July 6, 1976

[51] Int. Cl.[2] ..... E06C 1/397; E06C 5/00

[52] U.S. Cl. ..... 182/17; 182/106; 182/127

[58] Field of Search ..... 182/17, 15, 127, 106; 16/32, 33, 44

[56] References Cited

U.S. PATENT DOCUMENTS

| | | | |
|---|---|---|---|
| 2,624,590 | 11/1947 | Tilton | 182/17 |
| 2,923,373 | 2/1960 | Ledgerwood | 182/17 |

FOREIGN PATENT DOCUMENTS

| | | | |
|---|---|---|---|
| 548,651 | 9/1956 | Italy | 16/33 |

*Primary Examiner*—Reinaldo P. Machado
*Attorney, Agent, or Firm*—Dressler, Goldsmith, Clement, Gordon & Shore, Ltd.

[57] ABSTRACT

A safety ladder assembly having a plurality of steps and at least three support feet for supporting the ladder on a horizontal surface. A caster assembly having at least three casters for providing for rollingly transporting the ladder from one location to another. The casters are positively and conjointly moveable between a retracted storage position in which the support feet stably support the ladder on a horizontal surface and a second transporting position in which the casters stably support the ladder assembly on the horizontal surface with the support feet elevated thereabove so that the ladder assembly may be rollingly transported along the surface. A linkage interconnects the casters so that they may be raised and lowered via actuating and retracting pedals.

9 Claims, 6 Drawing Figures

FIG. 1
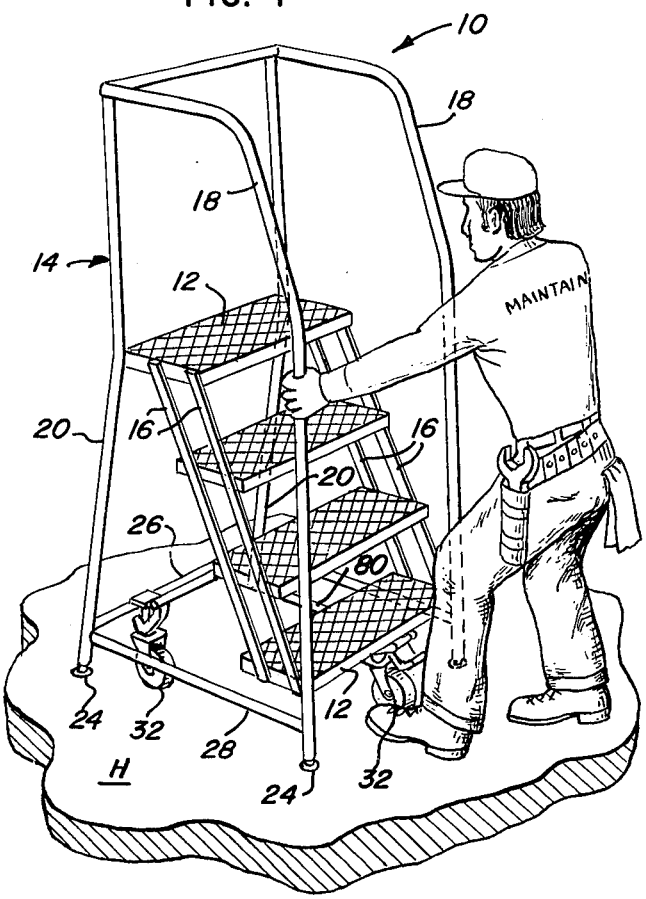
FIG. 2
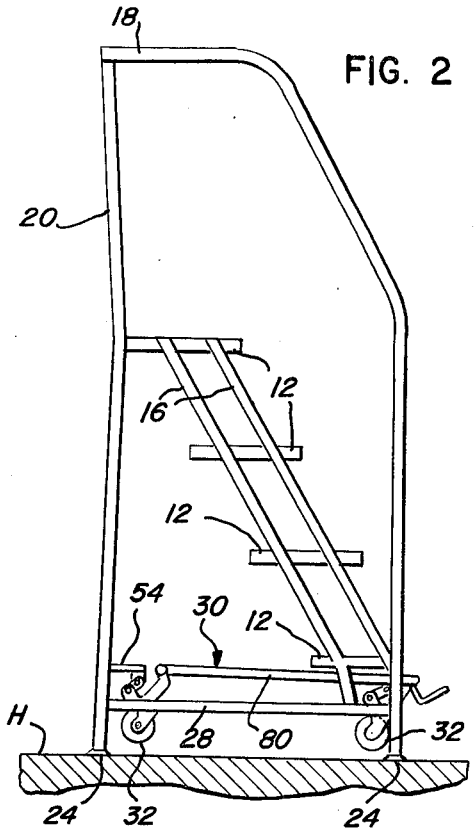
FIG. 5
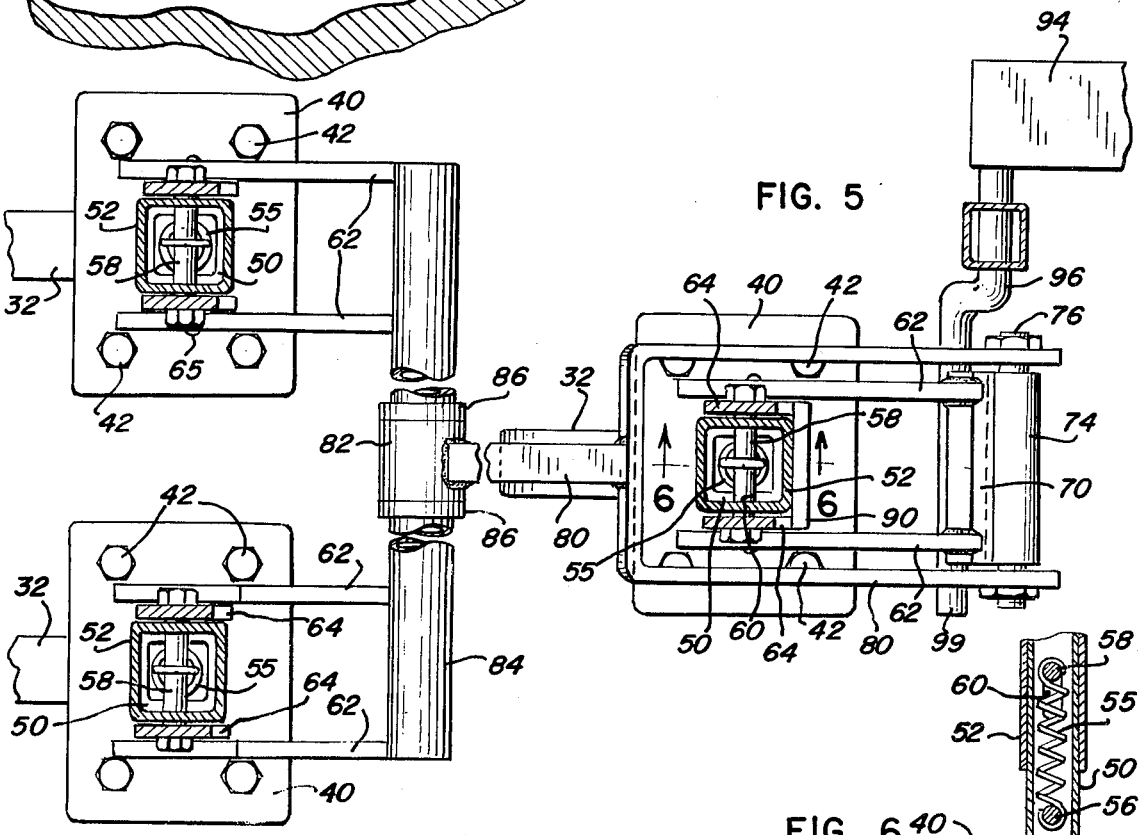
FIG. 6

SAFETY LADDER WITH CASTER ASSEMBLY MOVEABLE POSITIVELY TO A RETRACTED POSITION

This invention relates to a ladder provided with a caster assembly to facilitate its movement from one location to another, but which positively and conjointly moves the casters to a retracted storage position when the ladder is to be used.

There are many available ladders which are provided with casters to facilitate their movement from one location to another. Many such ladders require caster assemblies because they are either too large or too cumbersome to carry. Conventionally, such ladders use casters which move between a position in which they are operative to permit the ladder to be rolled along a surface to a second relatively elevated position in which ladder legs contact the surface upon which the ladder is to be supported for use.

Such ladders utilize casters which are spring biased downwardly, but which retract against the force of the springs when a user of the ladder exerts a downward force against the ladder, as by stepping on the first rung or step.

It has been determined that it is highly desirable, and especially for safety purposes, to provide a ladder assembly in which a caster assembly may be positively retracted to a storage position prior to use of the ladder so that the ladder can not inadvertantly move or accidentally roll on the casters as a user steps onto the ladder. It has also been determined that it is desirable to provide a ladder assembly in which the casters of the caster assembly may be moved from the retracted position into a transporting position positively, easily and conjointly.

In accordance with the present invention, a ladder assembly is provided with a caster assembly which is adapted to move the transporting casters positively between a retracted or storage position in which ladder support feet are disposed against and upon a support surface and a transporting position in which the transporting casters bear against the support surface and maintain the ladder support feet elevated above the support surface.

A ladder assembly in accordance with this invention comprises a frame, a plurality of steps and at least three support feet for supporting said ladder assembly on a generally horizontal surface. The ladder assembly includes a caster assembly having at least three casters upon which the ladder is adapted to be rollingly transported from one location to another.

The casters are mounted on the ladder assembly and are positively and conjointly moveable between a first retracted position in which the support feet stably support the ladder assembly on a horizontal surface and a second transporting position in which the casters stably support the ladder assembly on the horizontal surface with said support feet elevated thereabove so that said ladder assembly may be rollingly transported along the horizontal surface. A linkage interconnects the casters so that they may be moved conjointly between the retracted and transporting positions and an actuating means is provided for operating the linkage means.

Preferably the casters are mounted on tubular guides for reciprocatable movement between the retracted and transporting positions. Spring means normally urge the casters into the retracted position. The linkage includes lever means mounted for oscillation between a rest position in which the casters are retracted and the second transporting position against the force of the spring means, and until the lever means reaches an over-center position in which the casters are releasably locked in said transporting position.

The ladder assembly desireably also provides supplementary retracting means for engaging said linkage and for returning the lever means from said over-center position toward the rest position.

Preferably the actuating means comprises a foot pedal fixed to the linkage for operating the linkage.

Further objects, features and advantages of this invention will become apparent from the following description and drawings of which:

FIG. 1 illustrates a safety ladder assembly made in accordance with this invention.

FIG. 2 is a side elevational view of the safety ladder of FIG. 1;

FIG. 5 is a plan view taken substantially along the line 5—5 of FIG. 4; and FIG. 6 is a fragmentary cross-sectional view taken substantially along the line 6—6 of FIG. 5.

Figure 3:
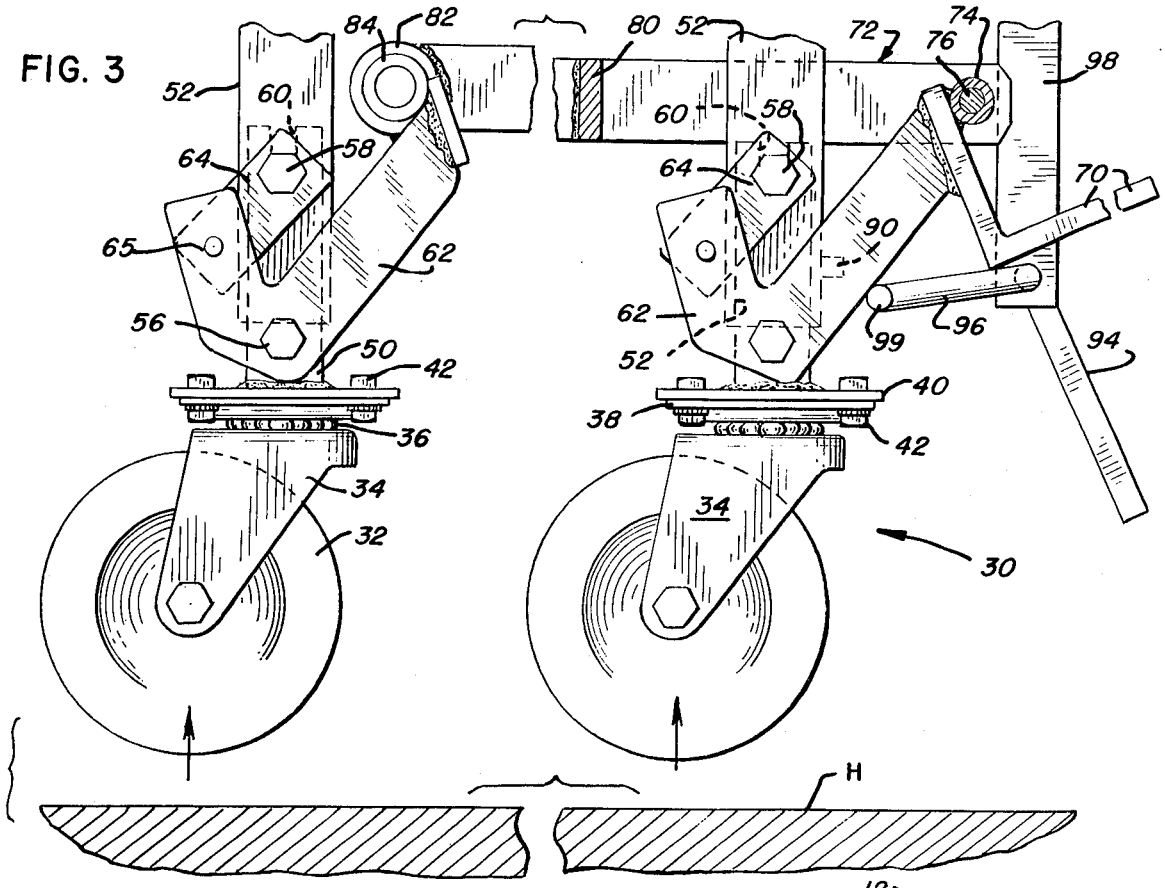
FIG. 3 is an enlarged fragmentary view of the ladder assembly of FIG. 2 with the caster assembly shown in a retracted position.

Referring now to the drawings, a ladder assembly 10 of this invention includes a plurality of steps 12. A frame assembly 14 includes a series of struts 16 which align and mount the steps and further includes a pair of hand rails 18 and a pair of support legs 20. An upper cross brace 22 interconnects the hand rails and support legs. A lower cross brace 26 which interconnects the support legs and lower side braces 28 which interconnect the hand rails and support legs all contribute to a stable rigid frame assembly for the ladder. The base of each of the support legs and hand rails provides a support foot 24. Support feet 24 lie in a common plane and are adapted to provide a stable support as on a generally horizontal surface H for the ladder assembly 10 when it is in use. Accordingly at least three support feet are required.

Because ladders, such as ladder assembly 10, are frequently heavy and cumbersome to move, a caster assembly is provided to rollingly transport the ladder assembly from place to place. The caster assembly of this invention is specially configured and adapted easily to move casters from an inactive, retracted storage position to a transporting position. When in the retracted position, the casters are elevated above the plane in which the support feet lie thereby to safeguard against possible inadvertant or accidental movement when the ladder assembly is in use. As will be described, the caster assembly is secured to the ladder assembly, as via a lower cross brace 26 and a lowermost step 12.

The caster assembly 30 comprises at least three casters 32 each of which is rotatably mounted on a swivel assembly, including a swivel 34, bearings 36 and a mounting plate 38. Mounting plate 38 is removably secured to a support plate 40 by suitable fasteners 42 so that the casters may be replaced as they wear out and as may be necessary.

Each of the support plates mounts a support column 50. Support columns 50 extend generally vertically upwardly from the support plates and are secured to the support plates as by welding. Support columns 50 are slidably and reciprocatably mounted within tubular guide means such as tubular housing members 52. The tubular housing members 52 are fixedly secured to the ladder assembly, thereby to permit support columns 50 to reciprocate and to move vertically relative to the ladder assembly, thereby to lower and to raise the casters 32.

To secure the housing members to the ladder assembly, at the rear of the ladder the tubular housing members 52 are fixedly secured to the lower cross brace 26 by short connector rods 54, as by welding. At the forward end, tubular housing member 52 is secured to a plate 53 which in turn is fixedly secured to the lowermost step 12, as by welding.

Each of the casters is mounted to be disposed in a first retracted position, such as that illustrated by FIG. 3. As best seen in FIGS. 3 and 6, each support column 50 and tubular housing member 52 cooperates to facilitate reciprocating movement of the support column, hence of the casters between the retracted and transporting positions. The uppermost retracted position is maintained by spring means such as tension springs 55 which bias and urge the casters 32 into the retracted position and which engage first mounting studs 56 fast with support columns 50 and second mounting studs 58 fast with tubular housing members 52. Each mounting stud 58 is slidably guided for reciprocating movement relative to support column 50 within guide notches 60 formed by support column 50 at its upper end.

Figure 4:
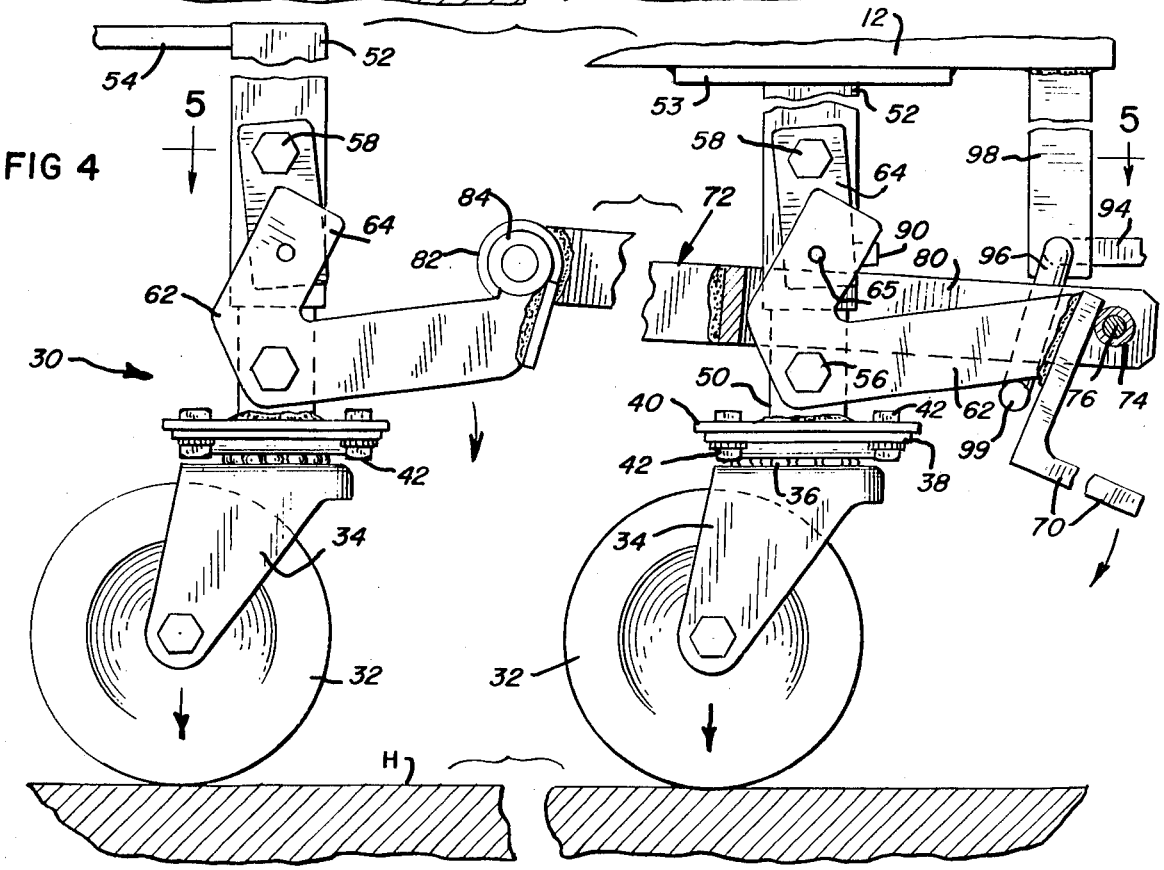
FIG. 4 is a view similar to FIG. 3 in which the caster assembly has been moved into a transporting position.

As best seen in FIGS. 3 and 4, the casters 32 are moveable from the upper retracted position ilustrated in FIG. 3 to the lower transporting position illustrated in FIG. 4. To affect this movement, a linkage assembly is provided. The linkage assembly includes lever means including pairs of generally J-shaped cam levers 62 which are mounted for oscillation about first mounting studs 56. As the pairs of cam levers are moved from the positions of FIG. 3 to those of FIG. 4, pairs of levers such as crank bars 64 which are mounted with second mounting studs 58 oscillate about mounting studs 58 and are caused to move vertically relative to guide notches 60. The crank bars 64 and cam levers 62 are pivotally interconnected by pivot rods 65. That movement from the rest or retracted position causes the mounting studs 56 and 58 to move away from each other, further tensioning springs 55, but forcing casters 32 downwardly relative to the remainder of the ladder assembly 10. As the movement continues, the crank bars reach an over-center position in which the casters are releasably locked in the transporting position. To return the casters to the position of FIG. 3, it is only necessary to reverse the direction of movement of the cam lever and crank bars. As they are moved in reverse direction, the springs 55 bias and urge the casters into the elevated storage position of FIG. 3.

Conjoint and positive movement of the casters from the retracted or storage position of FIG. 3 to the transport position of FIG. 4 in which the casters stably support the ladder assembly with the support feet elevated above surface H is accomplished via an actuating means such as an actuating pedal 70 and an operating linkage 72. Actuating pedal 70 is connected to the cam levers 62 associated with the front caster 32. Linkage 72 includes a bushing 74 which is fixed to actuating pedal 70. Bushing 74 oscillatably mounts a pivot rod 76 which is secured to the forward end of fork portion 80. The rearward end of fork portion 80 mounts a bushing 82 which oscillatably receives a connector rod 84. Connector rod 84 is secured, as by welding, to the forward ends of the pairs of cam levers 62 associated with the rear casters. Desirably, bushing 82 is fixed against lateral movement along connector rod 84, as by stops 86 which are secured, as by welding, to connector rod 84.

When actuating pedal 70 is moved from the upper position illustrated in FIG. 3 downwardly toward the lower transporting position of FIG. 4, the operating linkage 72 is moved forwardly and down. As it moves forwardly and down, it causes the cam levers 62 associated with both the front and rear casters 32 to move conjointly, via the pedal 70 and linkage 72, thereby to move all of the casters downwardly at the same time. To limit the forward and downward movement, stop means are provided. In the embodiment illustrated, a stop bar 90 is provided at the forward caster 32 to engage crank bars 64, as is best seen in FIG. 4. Stop bar 90 is positioned to engage crank bars 64 in positions in which the crank bar has traveled from its position of rest corresponding to the retracted position of the casters to the over-center position illustrated in FIG. 4. By allowing the crank bar 64 to come to the over-center position, the operating linkage and casters are releasably locked in the transporting position of FIG. 4 and to resist inadvertant retraction or self-retraction of the casters from the transporting position of FIG. 4 to the storage position of FIG. 3.

To return the casters to the retracted positions of FIG. 3 from that of FIG. 4, it is necessary to elevate the operating linkage 72. To that end, retracting means including a retracting pedal 94 is provided. As best seen in FIGS. 3, 4 and 5, retracting pedal 94 is provided with a crank arm 96 which is mounted for oscillation on a support tube 98. Support tube 98 is secured, as by welding, to the lowermost step 12 and provides bushing means for oscillating movement of the crank arm 96. One end 99 of crank arm 96 is positioned to underlie, engage and move the long legs of the forward pair of cam levers 62. When the retracting pedal 94 is moved downwardly, the crank arm 96 oscillates, its lower arm portion engages cam levers 62 causing the cam levers to move about mounting stud 56, moving the crank bars 64 from the over-center position of FIG. 4 toward the positions of FIG. 3 to which they are returned by the springs 55 which urge the casters to the rest and retracted position of FIG. 3 and in which position they are held by the tension springs 55.

Although a presently preferred embodiment of this invention has been described in detail, it will be apparent to those skilled in the art that modifications may be made without departing from the spirit and scope of the invention. Accordingly, I intend to be limited only as may be required by the appended claims.

What is claimed is:

1. A ladder assembly comprising a frame, a plurality of steps and at least three support feet for supporting said ladder assembly on a generally horizontal surface, said ladder assembly including a caster assembly upon which the ladder is adapted to be rollingly transported from one location to another, said caster assembly including at least three casters which are positively and conjointly movable between a first retracted position in which said support feet stably support said ladder assembly on said horizontal surface with said casters elevated thereabove and a second transporting position in which said casters stably support said ladder assembly on said horizontal surface with said support feet elevated thereabove, tubular guide means fixedly secured to said ladder assembly reciprocatably mounting said casters for reciprocating movement between said first and second positions, spring means urging said casters into said first retracted position, linkage means interconnecting said casters for conjoint movement, and actuating means for operating said linkage means to move said casters from said first to said second position.

2. A ladder assembly in accordance with claim 1 wherein said actuating means comprises a foot pedal fixed to said linkage means.

3. A ladder assembly comprising a frame, a plurality of steps and at least three support feet for supporting said ladder assembly on a generally horizontal surface, said ladder assembly including a caster assembly upon which the ladder is adapted to be rollingly transported from one location to another, said caster assembly including at least three casters which are positively and conjointly movable between a first retracted position in which said support feet stably support said ladder assembly on said horizontal surface and a second transporting position in which said casters stably support said ladder assembly on said horizontal surface with said support feet elevated thereabove, tubular guide means fixedly secured to said ladder assembly reciprocatably mounting said casters for reciprocating movement between said first and second positions, spring means urging said casters into said first retracted position, linkage means interconnecting said casters for conjoint movement, and actuating means for operating said linkage means to move said casters from said first to said second position, said linkage means comprising lever means mounted for oscillation between a rest position in which said casters are retracted towards said second transporting portion against the force of said spring means and an over-center position in which said casters are releasably locked in said transporting position.

4. A ladder assembly in accordance with claim 3 in which said lever means comprises a pivotally interconnected crank bar and cam lever oscillatably mounted respectively on said caster mounting means and said caster.

5. A ladder assembly in accordance with claim 3 further comprising retracting means for engaging said linkage means for returning said lever means from said over-center position toward said rest position.

6. A ladder assembly comprising a frame, a plurality of steps and at least three support feet for supporting said ladder assembly on a generally horizontal surface, said ladder assembly including a caster assembly upon which the ladder is adapted to be rollingly transported from one location to another, said caster assembly including at least three casters which are positively and conjointly movable between a first retracted position in which said support feet stably support said ladder assembly on said horizontal surface with said casters elevated thereabove and a second transporting position in which said casters stably support said ladder assembly on said horizontal surface with said support feet elevated thereabove, caster support members, each of which supports one of said casters mounted thereon wherein said casters are mounted for reciprocating conjoint movement between said first and second positions, a tubular member slidably receiving a caster support member, spring means connected to said tubular member and caster support member for biasing said casters toward said retracted position, linkage means interconnecting said casters for conjoint movement, and actuating means for operating said linkage means to move said casters from said first to said second position.

7. A ladder assembly in accordance with claim 6 wherein said linkage means includes lever means operative to act against said spring means and moveable between a rest position and an over-center position corresponding to said retracted and transporting positions respectively, and in which over-center position said caster support members and casters are releasably locked, and from which position said caster support members and casters are adapted to be returned by said springs to said rest positions.

8. A ladder assembly in accordance with claim 7 further comprising retracting means for returning said casters to said retracted position.

9. A ladder assembly in accordance with claim 8 in which said retracting means comprise a retracting pedal mounted on said ladder assembly, said retracting pedal comprising an arm positioned to engage and to move said lever means from said over-center position.

* * * * *